US008726796B2

(12) United States Patent
Park et al.

(10) Patent No.: US 8,726,796 B2
(45) Date of Patent: May 20, 2014

(54) SLIDING GRILL FIXING APPARATUS

(75) Inventors: Yoon Sig Park, Seoul (KR); Yong Won Choi, Incheon (KR); Duc Hoi Kim, Incheon (KR)

(73) Assignee: Segos Co., Ltd., Incheon (KR)

( * ) Notice: Subject to any disclaimer, the term of this patent is extended or adjusted under 35 U.S.C. 154(b) by 974 days.

(21) Appl. No.: 12/828,489

(22) Filed: Jul. 1, 2010

(65) Prior Publication Data

US 2011/0005405 A1 Jan. 13, 2011

(30) Foreign Application Priority Data

Jul. 8, 2009 (KR) ..... 10-2009-0062310
Dec. 2, 2009 (KR) ..... 10-2009-0118568

(51) Int. Cl.
*A47J 37/07* (2006.01)

(52) U.S. Cl.
USPC ..... 99/450; 99/449; 219/169.1

(58) Field of Classification Search
USPC ..... 99/450, 449, 427
See application file for complete search history.

(56) References Cited

U.S. PATENT DOCUMENTS 7,856,970 B1 * 12/2010 Brown ..... 126/25 R
2005/0217501 A1 * 10/2005 Babucke et al. ..... 99/450
2008/0237166 A1 * 10/2008 Williams et al. ..... 211/169.1

* cited by examiner

*Primary Examiner* — Henry Yuen
*Assistant Examiner* — Phuong Nguyen
(74) *Attorney, Agent, or Firm* — The PL Law Group, PLLC

(57) ABSTRACT

Provided is a sliding grill fixing apparatus, which is installed on a sliding grill. The sliding grill fixing apparatus includes an actuating lever that runs across a sliding grill in a horizontal direction between opposite inner faces of the sliders and has a grip in the middle thereof, actuating legs that protrude downward from opposite ends of the actuating lever, actuating hinges that are disposed between the actuating legs and the opposite inner faces of the sliders in a horizontal direction, driving brackets that are moved in one direction by rotation of the actuating legs, actuating brackets that move together with the driving brackets to be inserted into the fixing recesses, and fixing hinges, each of which is disposed between each actuating bracket and the outer face of each slider and is hinged to the outer face of each slider such that each actuating bracket can rotate.

4 Claims, 8 Drawing Sheets

SLIDING GRILL FIXING APPARATUS

CROSS REFERENCE

This application claims foreign priority under Paris Convention and 35 U.S.C. §119 to Korean Patent Application No. 10-2009-0062310, filed Jul. 8, 2009 and Korean Patent Application No. 10-2009-0118568, filed Dec. 2, 2009 with the Korean Intellectual Property Office.

BACKGROUND OF THE INVENTION

1. Technical Field

The present invention relates to a sliding grill fixing apparatus.

2. Description of the Related Art

Generally, cooking utensils such as gas ovens, electric ovens, etc. are configured so that a grill on which stuff to be cooked is placed is installed in a chamber to be heated. The grill is adapted to be taken into and out of the chamber of the cooking utensil with the cooking stuff placed thereon. Since the grill is typically used inside the cooking utensil, the grill is shaped like a net so as to enhance the efficiency of transferring heat to the stuff to be cooked. The net-shaped grill may be equipped with sliders on opposite sides thereof so as to slidably taken into and out of the chamber of the cooking utensil.

A conventional sliding grill is taken out by user. The user places cooking stuff on the sliding grill, pushes the sliding grill into a cooking utensil, fixes the sliding grill to the cooking utensil using fixtures, and closes a door of the cooking utensil to cook the cooking stuff. Here, the sliding grill is positioned according to a size of the cooking stuff, and is fixed by the fixtures. In this state, the cooking stuff can be cooked. In other words, the sliding grill has the fixtures positioned and fixed according to the size of the cooking stuff in a chamber of the cooking utensil.

Such fixtures are installed on opposite sliding sides of the sliding grill, and are inserted into recesses formed in the chamber of the cooking utensil, thereby fixing the sliding grill. When the sliding grill is taken inside, each fixture is rotated and inserted at a fixed position by the elastic force of an elastic member. When the sliding grill is taken outside, each fixture is rotated and then unfixed. The recesses formed in the cooking utensil are arranged such that the sliding grill can be positioned and fixed in a vertical direction. The fixtures installed on the opposite sides of the sliding grill are independently operated. When the sliding grill moves in a vertical direction, the fixtures are independently operated to release the sliding grill. Then, when the released sliding grill is inserted at the desired position, the fixtures are caught in the recesses disposed at the desired position by the elastic members without being separately manipulated, and are rotated and inserted by the elastic force of the elastic members. Consequently, when any one of the fixtures independently operated on the opposite sides of the cooking utensil on taking out the sliding grill is not operated, the fixture is not unfixed and thus the sliding grill cannot be released.

As the fixtures of the sliding grill must be unfixed by the user using both hands, it is difficult to manipulate the fixtures, which results in reducing the convenience of use.

Further, when the fixtures installed on the opposite sides of the sliding grill are manipulated, the force applied by each hand of the user is different. As such, a uniform force is not applied to the fixtures. In this way, when the fixtures are operated using different force, and particularly when one of the fixtures is operated with a relatively smaller force, the fixture is not unfixed. In contrast, when one of the fixtures is operated with a relatively greater force, the fixture is damaged or broken, which leads to reducing the usable lifetime of the fixture.

SUMMARY OF THE INVENTION

Accordingly, the present invention has been made keeping in mind the above problems occurring in the related art, and an object of the present invention is to provide a sliding grill fixing apparatus, in which locking units are installed on opposite sides of a sliding grill that is slidably installed in a cooking utensil, thereby allowing the sliding grill to be fixed or unfixed by a single manipulation, and improving the convenience of use.

According to one aspect of the present invention, there is provided a sliding grill fixing apparatus, which is installed on a sliding grill, on opposite sides of which sliders are installed, so as to be fixed in fixing recesses inside a cooking utensil. The sliding grill fixing apparatus comprises: an actuating lever that runs under and across the sliding grill in a horizontal direction between opposite inner faces of the sliders and has a grip in the middle thereof; actuating legs that protrude downward from opposite ends of the actuating lever; actuating hinges that are disposed between the actuating legs and the opposite inner faces of the sliders in a horizontal direction and hinge the actuating legs to the opposite inner faces of the sliders so as to be able to be moved by rotation; driving brackets, each of which is disposed in a direction from one side of each actuating leg toward an outer face of each slider and is moved to one side by rotation of each actuating leg; actuating brackets that are disposed upward at outer ends of the driving brackets so as to be parallel to the outer faces of the sliders and move together with the driving brackets to be inserted into the fixing recesses; and fixing hinges, each of which is disposed between each actuating bracket and the outer face of each slider and is hinged to the outer face of each slider such that each actuating bracket can rotate. When the actuating lever is operated to another side with the grip gripped by a user, the actuating legs rotate about the actuating hinges and move the driving brackets in one direction. When the driving brackets are moved in one direction by the rotation of the actuating legs, the actuating brackets rotate about the fixing hinges so as to release a fixed state where the actuating brackets are inserted into the fixing recesses.

Here, the sliding grill fixing apparatus may further comprise actuating elastic members, each of which encloses an outer surface of each actuating hinge and elastically supports each actuating leg. The actuating elastic members may be subjected to torsion when the actuating lever is operated, and allow the actuating lever to return to initial positions thereof after the actuating lever is operated.

Further, the sliding grill fixing apparatus may further comprise: elastic member supports, each of which protrudes inward with respect to the inner face of each slider, is located on one side of a lower portion of each actuating leg, and supports a lower end of each actuating elastic member, an upper end of which is supported on one side of an upper portion of each actuating leg; and stoppers, each of which protrudes inward with respect to the inner face of each slider, is located on the other side of the upper portions of each actuating leg, and restricts a rotating range of each actuating leg. Each actuating leg rotating about each actuating hinge may receive an elastic force applied from one side to the other side of the upper portion thereof by each actuating elastic member supported by each elastic member support, and each stopper may restrict the rotation of each actuating leg, which is rotated by the elastic force of each actuating elastic member, to allow each actuating leg to maintain the initial position thereof.

In addition, the sliding grill fixing apparatus may further comprise fixing elastic members, each of which encloses an outer surface of each fixing hinge and elastically supports each actuating bracket. The fixing elastic members may be subjected to torsion when the actuating lever is operated, and allow the actuating brackets to be returned to positions where the actuating brackets are inserted into the fixing recesses before the actuating lever is operated. The actuating brackets elastically supported by the fixing elastic members may be inserted into and fixed in the fixing recesses by the elastic force of the fixing elastic members, which are subjected to torsion when the sliding grill is inserted, without operating the actuating lever.

BRIEF DESCRIPTION OF THE DRAWINGS

The above and other objects, features and advantages of the present invention will be more clearly understood from the following detailed description when taken in conjunction with the accompanying drawings, in which.

DESCRIPTION OF SPECIFIC EMBODIMENTS

Figure 1:
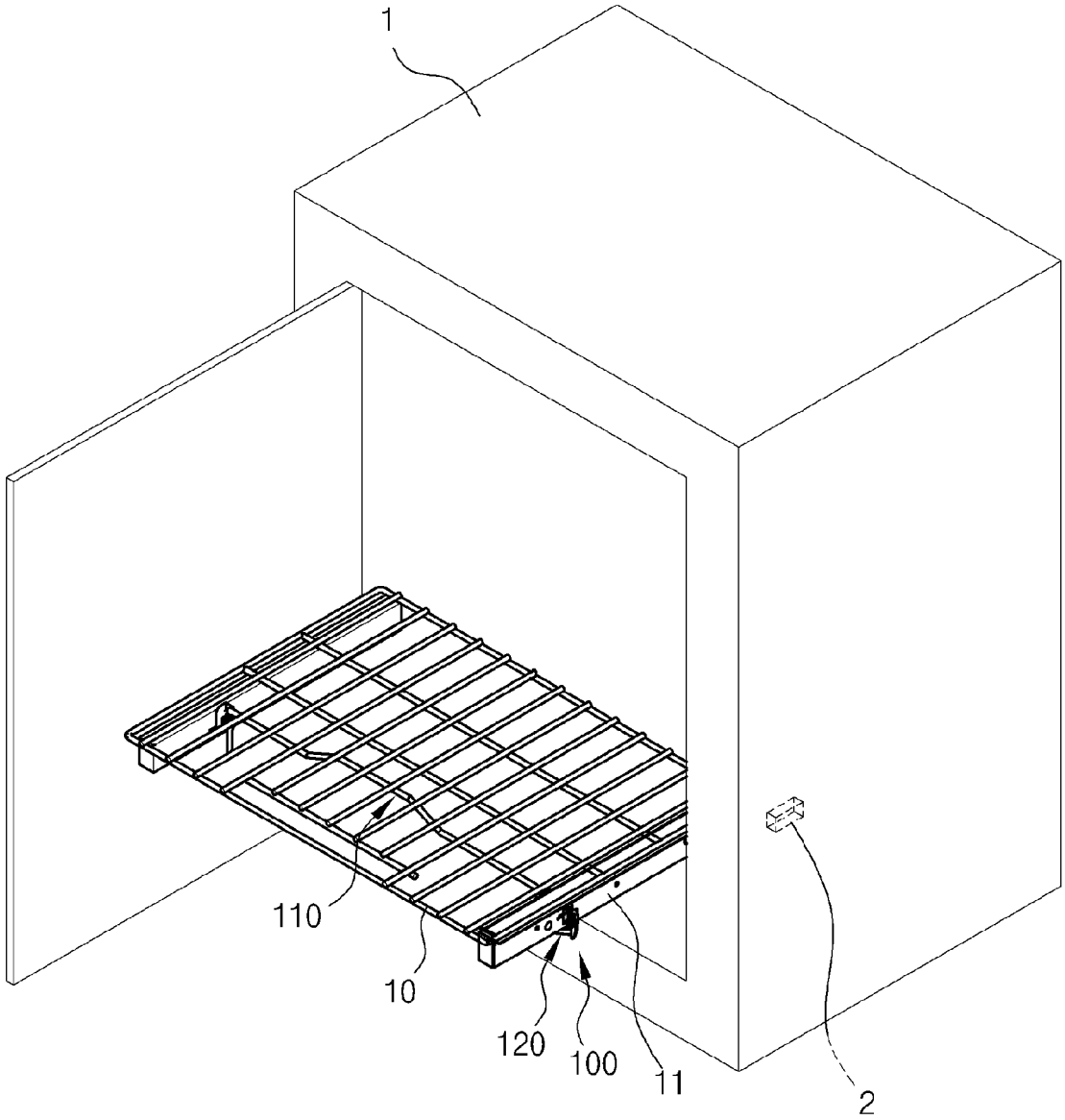
FIG. 1 illustrates the state in which a sliding grill fixing apparatus according to an exemplary embodiment of the present invention is installed on a cooking utensil.

Reference will now be made in greater detail to an exemplary embodiment of the invention, an example of which is illustrated in the accompanying drawings. Wherever possible, the same reference numerals will be used throughout the drawings and the description to refer to the same or like parts.

Hereinafter, both a sliding grill on which the sliding grill fixing apparatus according to an exemplary embodiment of the present invention is installed and a cooking utensil on which the sliding grill is installed will be described with reference to FIGS. 1 through 3.

Figure 2:
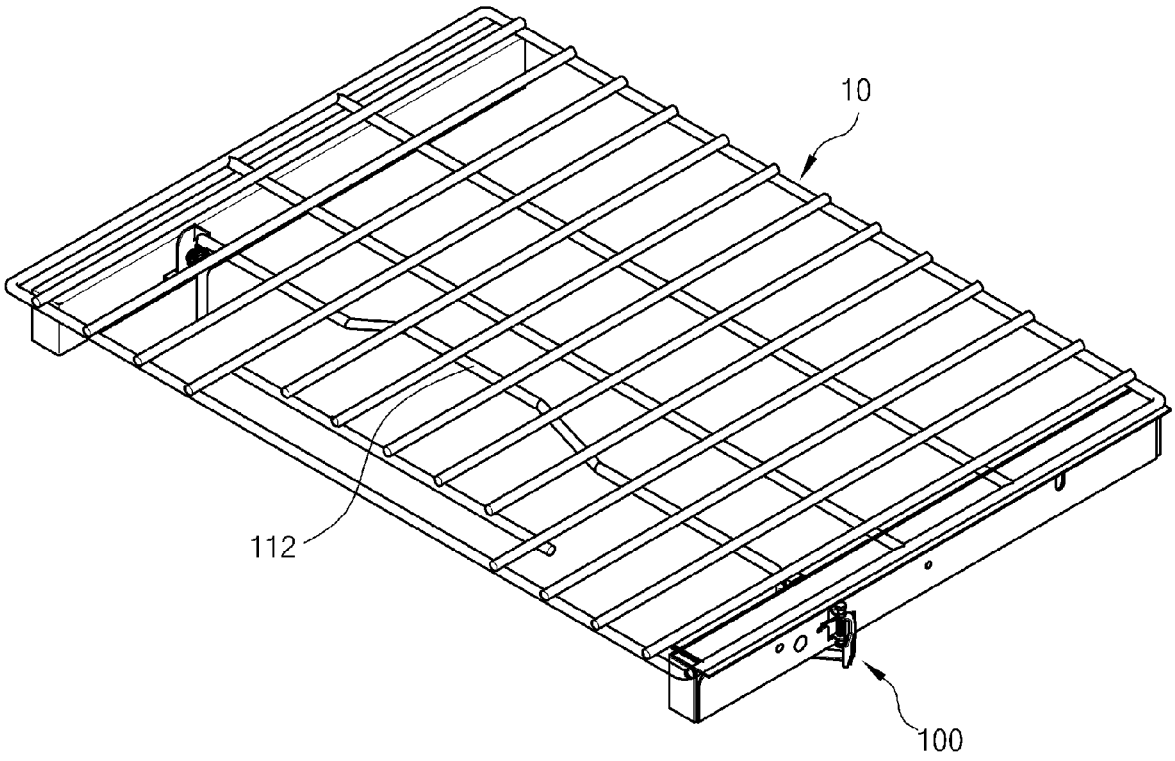
FIG. 2 is a perspective view illustrating a sliding grill on which the sliding grill fixing apparatus of FIG. 1 is installed.
Figure 3:
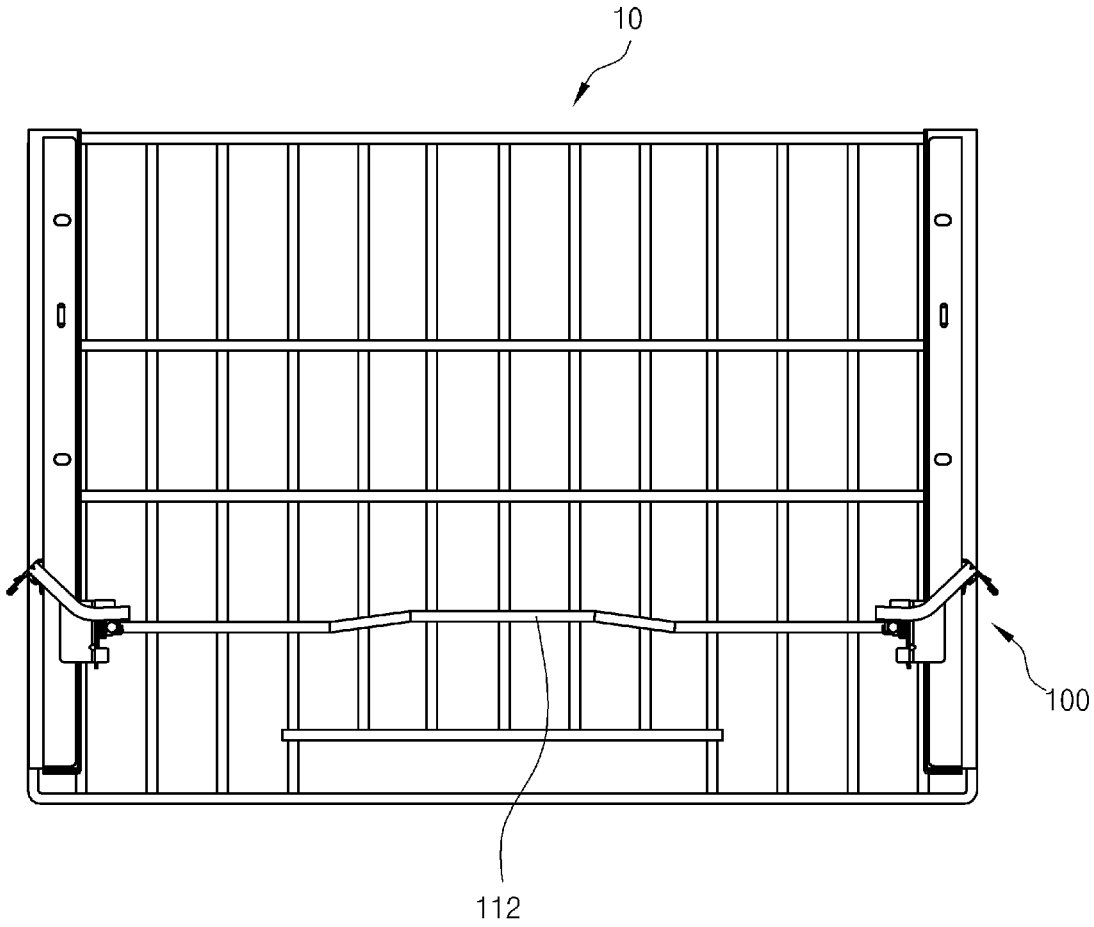
FIG. 3 is a bottom view illustrating the sliding grill of FIG. 2.

FIG. 1 illustrates the state in which a sliding grill fixing apparatus according to an exemplary embodiment of the present invention is installed on a cooking utensil, FIG. 2 is a perspective view illustrating a sliding grill on which the sliding grill fixing apparatus of FIG. 1 is installed, and FIG. 3 is a bottom view illustrating the sliding grill of FIG. 2.

Referring to FIGS. 1 through 3, the sliding grill fixing apparatus 100 according to an exemplary embodiment of the present invention is installed on a sliding grill 10. The sliding grill 10 is installed in a cooking utensil 1 in which fixing recesses 2 are formed. The sliding grill 10 includes sliders 11 and the sliding grill fixing apparatus 100. The cooking utensil 1 cooks the stuff to be cooked, and may include an electronic oven, a gas oven, a microwave oven, or a gas range. In other words, the cooking utensil 1 includes all the typical appliances capable of cooking the cooking stuff. The cooking utensil 1 has the fixing recesses 2 on opposite inner walls thereof where the sliding grill 10 on which the cooking stuff is placed is fixed. The fixing recesses 2 are formed in positions opposing each other at the positions where the sliding grill 10 is fixed, and may be arranged in a vertical direction such that the sliding grill 10 can be fixed while moving in a vertical direction.

The sliding grill 10 can be taken into and out of the cooking utensil 1 with the cooking stuff placed thereon. The sliding grill 10 is formed in a net shape such that heat generated from the cooking utensil 1 can be transferred to the cooking stuff when the cooking stuff is heated. The sliding grill 10 can move inside and outside the cooking utensil 1 with the cooking stuff still on it.

The sliders 11 are disposed on opposite sides of the sliding grill 10, and are installed such that the sliding grill 10 is slidably put in and taken out of the cooking utensil 1.

Here, the sliders 11 may include all typical slidable members that allow the sliding grill 10 to be slidably taken into and out of the cooking utensil 1. For example, slidable rails may be installed on opposite sides of the sliding grill 10, and stationary rails may be installed inside the cooking utensil 1. Rolling members such as balls, rollers, etc. may be installed between the slidable rails and the stationary rails. The sliding grill 10 may be put in and taken out of the cooking utensil 1 using the rolling members. As described above, since the sliders 11 include all the typical slidable members, the detailed description thereof will be omitted.

The sliding grill fixing apparatus 100 includes locking units, which are installed on the opposite sides of the sliding grill 10 and are coupled to the sliders 11. When the sliding grill 10 is taken in and out, the sliding grill fixing apparatus 100 is inserted into and removed from the fixing recesses. When the sliding grill 10 is put in, the sliding grill fixing apparatus 100 is inserted into and fixed in the fixing recesses. When the sliding grill 10 is taken out, the sliding grill fixing apparatus 100 is removed from the fixing recesses. Thus, the sliding grill fixing apparatus 100 is installed such that the sliding grill 10 can be fixed inside the cooking utensil 1.

The aforementioned sliding grill fixing apparatus 100 according to an exemplary embodiment of the present invention will be described with reference to FIGS. 4 through 6.

Figure 4:
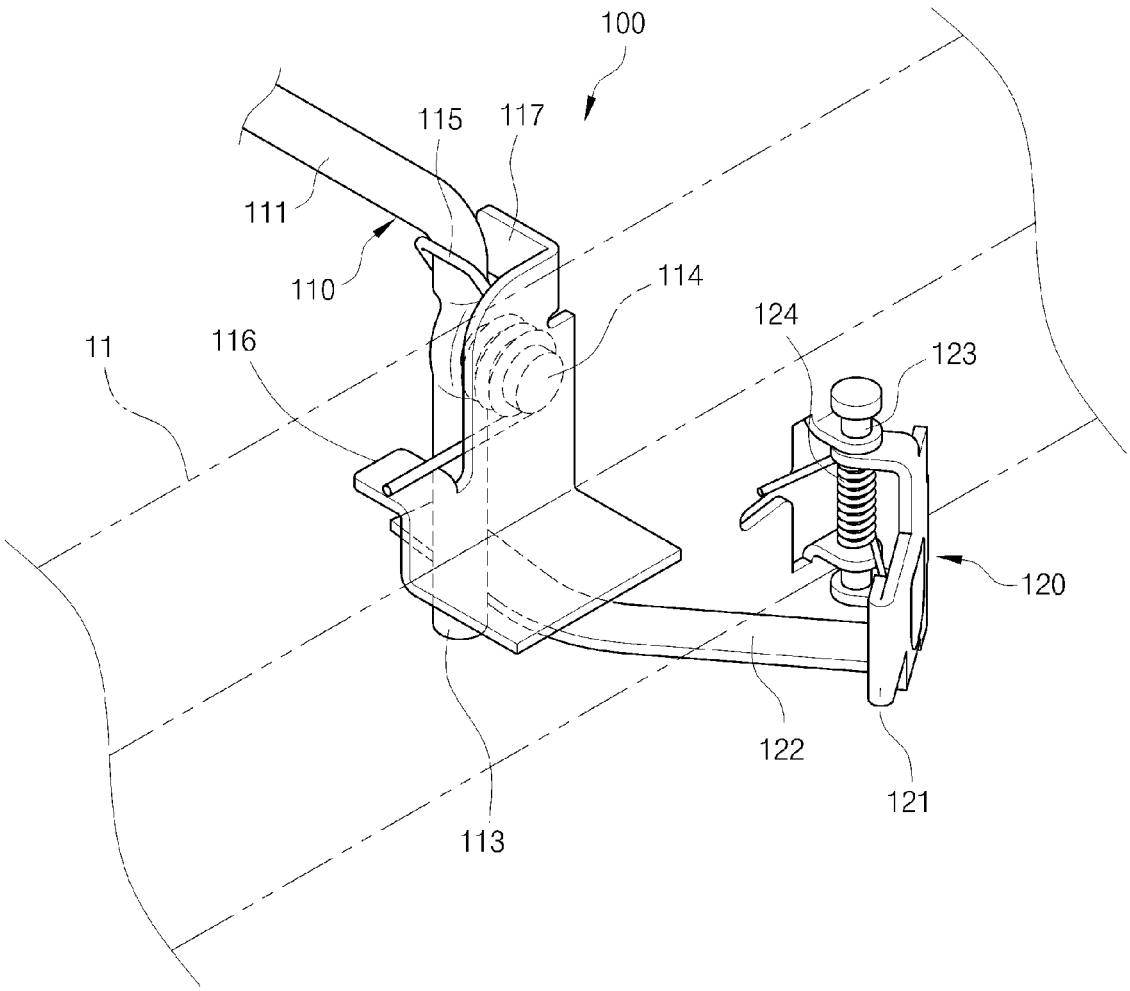
FIG. 4 is a partial cutaway perspective view illustrating main parts of the sliding grill fixing apparatus of FIG. 2.
Figure 5:
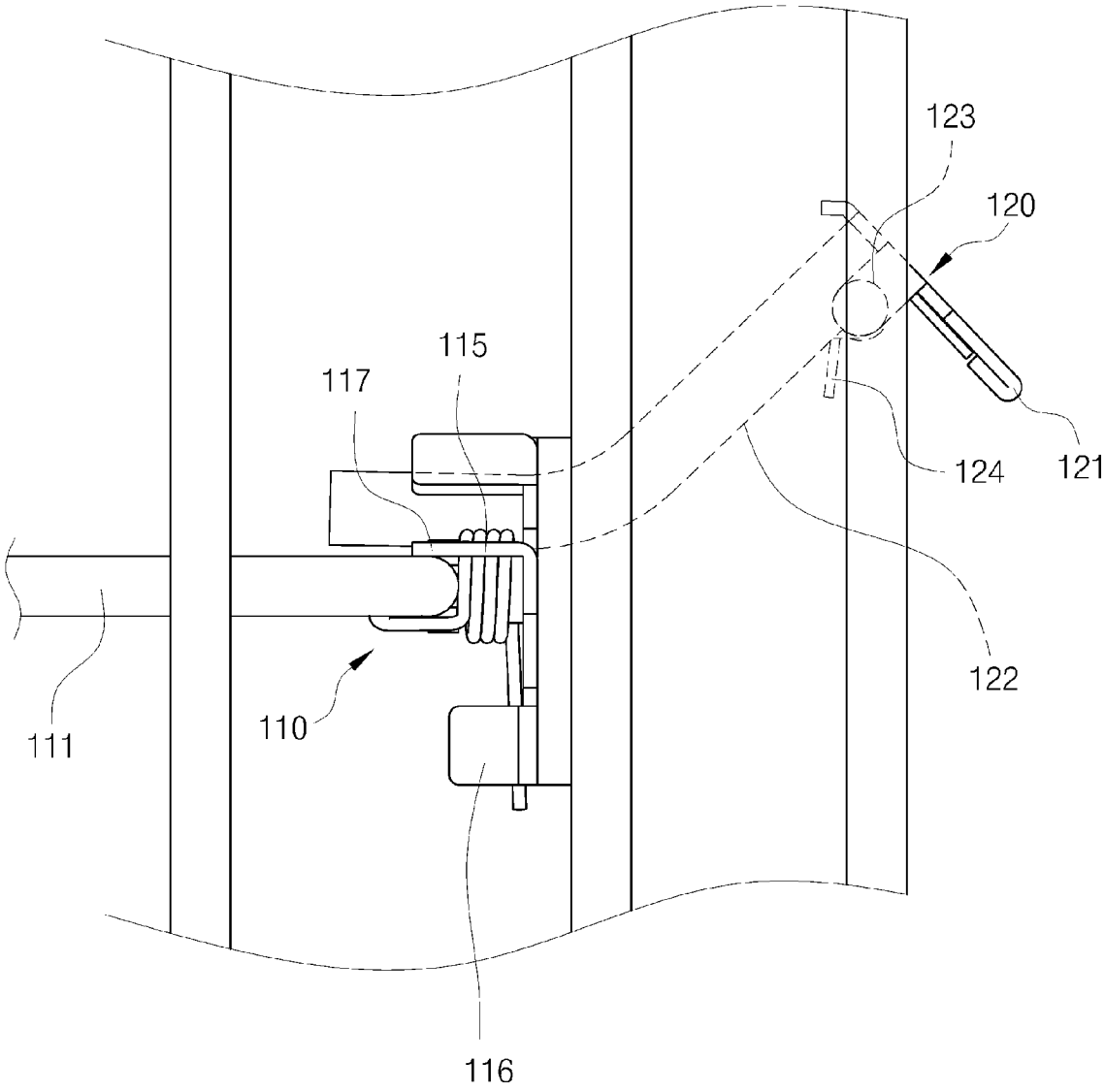
FIG. 5 is a partial cutaway plan view illustrating the sliding grill fixing apparatus of FIG. 4.
Figure 6:
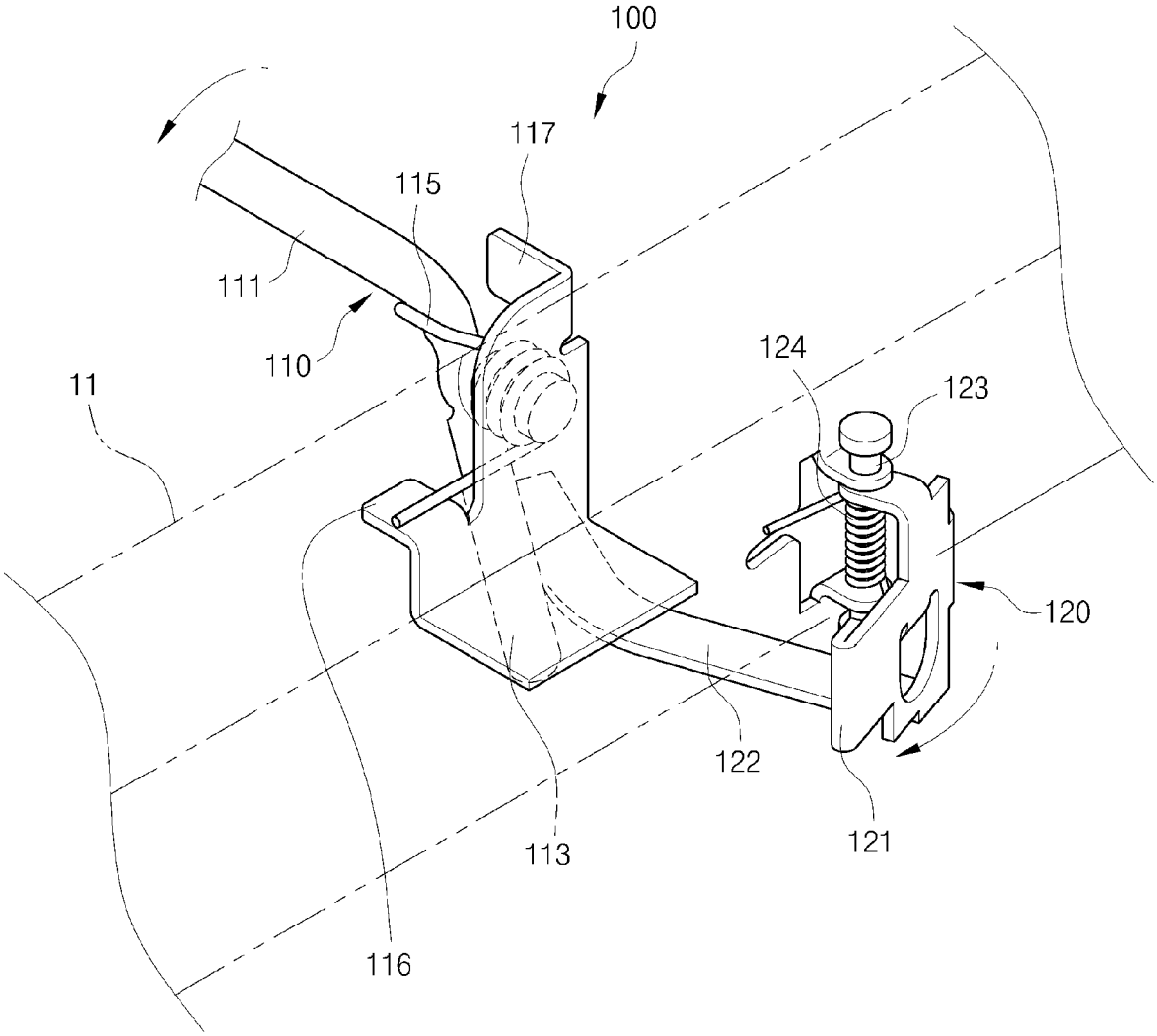
FIG. 6 is a partial cutaway perspective view illustrating how to use the sliding grill fixing apparatus of FIG. 4.

FIG. 4 is a partial cutaway perspective view illustrating main parts of the sliding grill fixing apparatus of FIG. 2, FIG. 5 is a partial cutaway plan view illustrating the sliding grill fixing apparatus of FIG. 4, and FIG. 6 is a partial cutaway perspective view illustrating how to use the sliding grill fixing apparatus of FIG. 4.

Referring to FIGS. 4 through 6, the sliding grill fixing apparatus 100 according to an exemplary embodiment of the present invention includes an actuator 110 and locking units 120. The actuator 110 includes an actuating lever 111, a grip 112, actuating legs 113, actuating hinges 114, actuating elastic members 115, elastic member supports 116, and stoppers 117. The actuating lever 111 runs under and across the sliding grill 10 in a horizontal direction between opposite inner faces of the sliders 11 disposed on the opposite sides of the sliding grill 10. The grip 112, which can be gripped by a user, is formed in the middle of the actuating lever 111. The actuating lever 111 is located under and across the net-shaped sliding grill 10 between the sliders 11 disposed on the opposite sides of the sliding grill 10, and is exposed such that the hand of the user can enter an empty space of the net-shaped sliding grill 10 to grip the grip 112. In other words, when the sliding grill fixing apparatus 100 is operated, the user can insert one hand into the net-shaped sliding grill 10, and grip the grip 112 to operate the actuating lever 111.

The actuating legs 113 extend downward from opposite ends of the actuating lever 111, and are integrally formed with the actuating lever 111. When the user operates the actuating lever 111, the integrated actuating legs 113 co-operate to actuate the locking units 120. The actuating legs 113 protrude downward from the opposite ends of the actuating lever 111 located between the opposite inner faces of the sliders 11.

The actuating hinges 114 hinge the actuating legs 113, which protrude from the opposite ends of the actuating lever 111, to the opposite inner faces of the sliders 11 in a horizontal direction, respectively. Since the actuating legs 113 are hinged to the inner faces of the sliders 11 by the actuating hinges 114, the actuating legs 113 can pivot about the actuating hinges 114 to move backward and forward. The actuating legs 113, which are integrally formed with the actuating lever 111, are hinged to the inner faces of the sliders 11 by the actuating hinges 114, so that they can pivot about the actuating hinges 114 and operate backward and forward. Thus, when the user grips and pulls the grip 112 of the actuating lever 111 in a forward direction, the actuating legs 113 rotate about the actuating hinges 114. When the actuating legs 113 rotate, the upper portion of each actuating leg 113, which is located above each actuating hinge 114, moves forward, while the lower portion of each actuating leg 113, which is located below each actuating hinge 114, moves backward. The locking units 120 operate in concert with the movement of the actuating legs 113 so that the sliding grill 10 can be fixed and unfixed.

Each actuating elastic member 115 encloses an outer surface of each actuating hinge 114, and one end thereof is supported on an upper portion of each actuating leg 113. Each actuating elastic member 115 is installed so as to apply an elastic force to the upper portion of each actuating leg 113 from the front to the back. When the actuating lever 111 is operated to unfix the sliding grill 10, the upper portion of each actuating leg 113 rotates about each actuating hinge 114 in a forward direction. When the upper portion of each actuating leg 113 moves forward, i.e. rotates in a counterclockwise direction, each actuating elastic member 115, one end of which is supported on the upper portion of each actuating leg 113, is subjected to torsion. When the operation of the actuating lever 111 is completed, the upper portion of each actuating leg 113 moves backward so as to return to its initial position owing to the elastic force of each actuating elastic member 115 that has been subjected to torsion. When the actuating legs 113 move, the actuating lever 111 integrally formed with the actuating legs moves together to return to its initial position. Thus, the actuating lever 111 and the actuating legs 113 move and return to their initial positions by the elastic force of the actuating elastic members 115, so that the sliding grill fixing apparatus 100 can be repetitively used. Preferably, as each actuating elastic member 115, an elastic member such as a coil spring may be used.

The elastic member supports 116 protrude inward with respect to the opposite inner faces of the sliders 11, and are located in front of lower portions of the actuating legs 113. One end of each actuating elastic member 115 is supported on the upper portion of each actuating leg 113, and the other end of each actuating elastic member 115 is supported on each elastic member support 116. Each elastic member support 116 supports the other end of each actuating elastic member 115, the elastic force of which is provided to each actuating leg 113.

The stoppers 117 protrude inward with respect to the opposite inner faces of the sliders 11, and are located in the rear of the upper portions of the actuating legs 113. The upper portions of the actuating legs 113, each of which returns to its initial position when the operation of the actuating lever 111 is completed, rotate and move backward by means of the actuating elastic members 115 that have been subjected to torsion at the upper portions of the actuating legs 113. Without the stopper 117, the upper portions of the actuating legs 113 may rotate and move backward beyond their initial positions by means of the elastic force of the actuating elastic members 115. For this reason, the stoppers 117 are installed in the rear of the upper portions of the actuating legs 113, and restrict the rotational angle such that operating the actuating elastic members 115 causes the actuating legs 113 to stay in their initial positions.

Each locking unit 120 includes an actuating bracket 121, a driving bracket 122, a fixing hinge 123, and a fixing elastic member 124, all of which are disposed on an outer face of each of the sliders 11 disposed on the opposite sides of the sliding grill 10. The actuating bracket 121, which is disposed on the outer face of each of the sliders 11 disposed on the opposite sides of the sliding grill 10, is installed so as to be inserted into the fixing recess 2 of the cooking utensil 1. The actuating bracket 121 is inserted into the fixing recess 2, thereby fixing the sliding grill 10. The actuating bracket 121 rotates to unfix the sliding grill 10.

The driving bracket 122 extends from a lower portion of the actuating bracket 121 beyond the actuating leg 113, is disposed in the rear of the actuating leg 113, and is integrally formed with the actuating bracket 121. The driving bracket 122 extends from the lower portion of the actuating bracket 121 beyond a lower face of the slider 11, and is disposed in the rear of the actuating leg 113 such that the actuating leg 113 rotating about the actuating hinge 114 can move backwards while being in contact with the driving bracket 122. When rotating about the actuating hinge 114 to move backward, the actuating leg 113 comes into contact with the driving bracket 122, and moves the driving bracket 122 in a backward direction. When the driving bracket 122 moves backward, the actuating bracket 121 integrally formed with the driving bracket 122 moves in concert therewith.

The fixing hinge 123 is disposed in a vertical direction between the actuating bracket 121 and the outer face of each of the sliders 11 disposed on the opposite sides of the sliding grill 10, and hinges the actuating bracket 121 to the outer face of the slider 11 such that the actuating bracket 121 can rotate. When the rotation of the actuating leg 113 moves the driving bracket 122 integrally formed with the actuating bracket 121 backwards, the actuating bracket 121 rotates about the fixing hinge 123 disposed in a vertical direction, and moves toward the slider 11. In other words, the actuating bracket 121 can move from the outer face of the slider 11 toward the fixing recess 2 of the cooking utensil while rotating about the fixing hinge 123. In detail, when moving together with the driving bracket 122 (which is being moved toward the slider by the operation of the actuating leg 113), the rotation about the fixing hinge 123 withdraws the actuating bracket 121 from the fixing recess 2, so that the sliding grill 10 can be unfixed.

The fixing elastic member 124 encloses an outer surface of the fixing hinge 123, and is elastically supported on the actuating bracket 121. The fixing elastic member 124 is elastically supported so as to be able to maintain the actuating bracket 121 rotating about the fixing hinge 123 at its initial position. The actuating bracket 121 is inserted into the fixing recess 2 of the cooking utensil 1, fixes the sliding grill 10 in the cooking utensil 1, and rotates to an unfixed position by the operation of the actuating lever 111. Thereby, the fixing elastic member 124 is subjected to torsion. When rotating to unfix the sliding grill 10, the actuating bracket 121 returns to its initial position where it can be inserted into the fixing recess 2 by means of the elastic force of the fixing elastic member 124 that has been subjected to torsion. Thus, since the actuating bracket 121 returns to its initial position, i.e. a fixed position, by means of the elastic force of the fixing elastic member 124, it can be used repetitively. Further, the actuating bracket 121 elastically supported by the fixing elastic member 124 is rotated by the elastic force when the sliding grill 10 is put in, and is inserted into and fixed in the fixing recess 2 without any separate motion, improving the convenience of fixing the sliding grill 10. Preferably, as the fixing elastic member 124, an elastic member such as a coil spring may be used.

The operation of the sliding grill fixing apparatus, configured as described above, according to an exemplary embodiment of the present invention will be described with reference to FIGS. 7 and 8.

Figure 7:
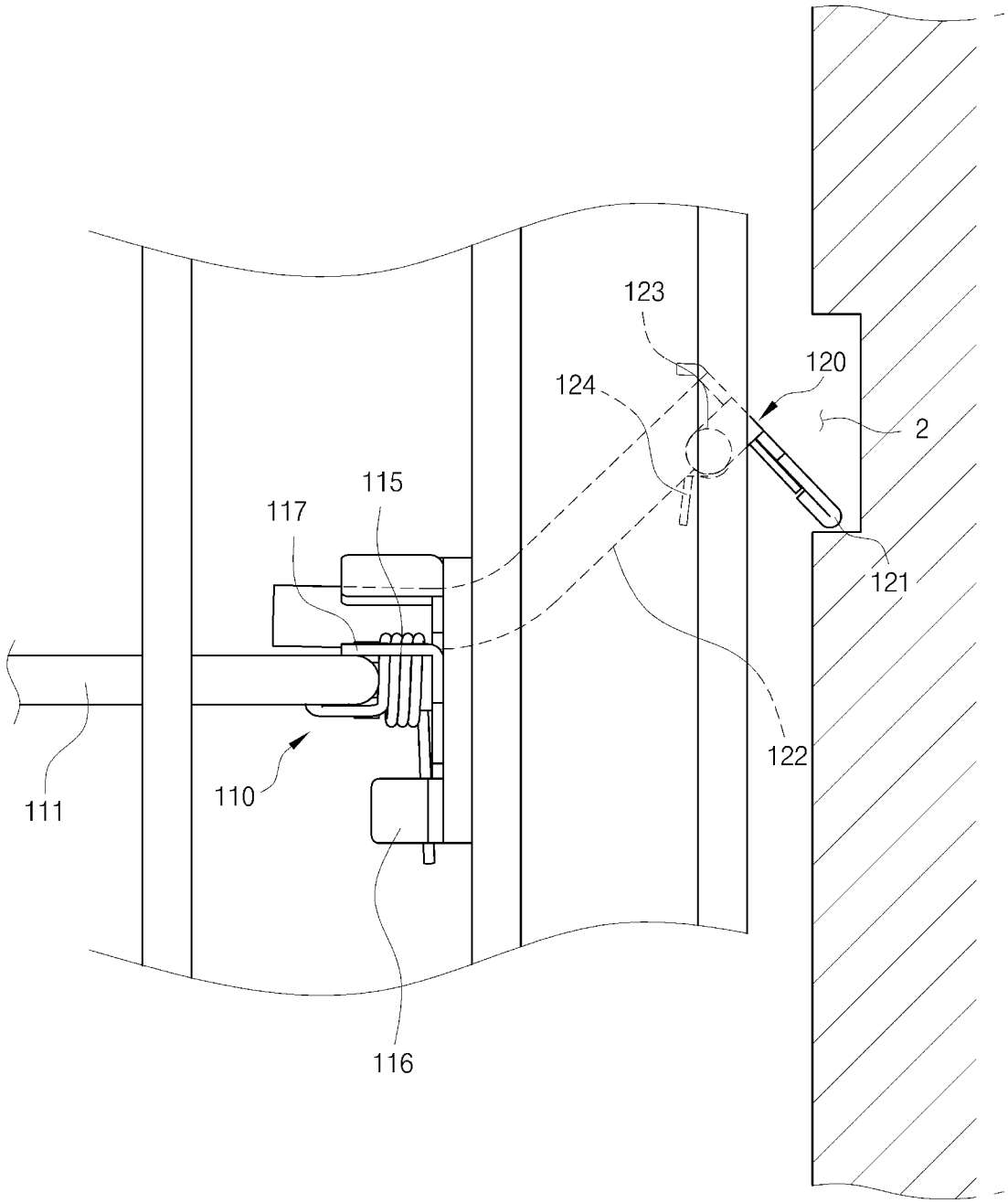
FIG. 7 illustrates the state where a sliding grill is fixed by the sliding grill fixing apparatus of FIG. 5.
Figure 8:
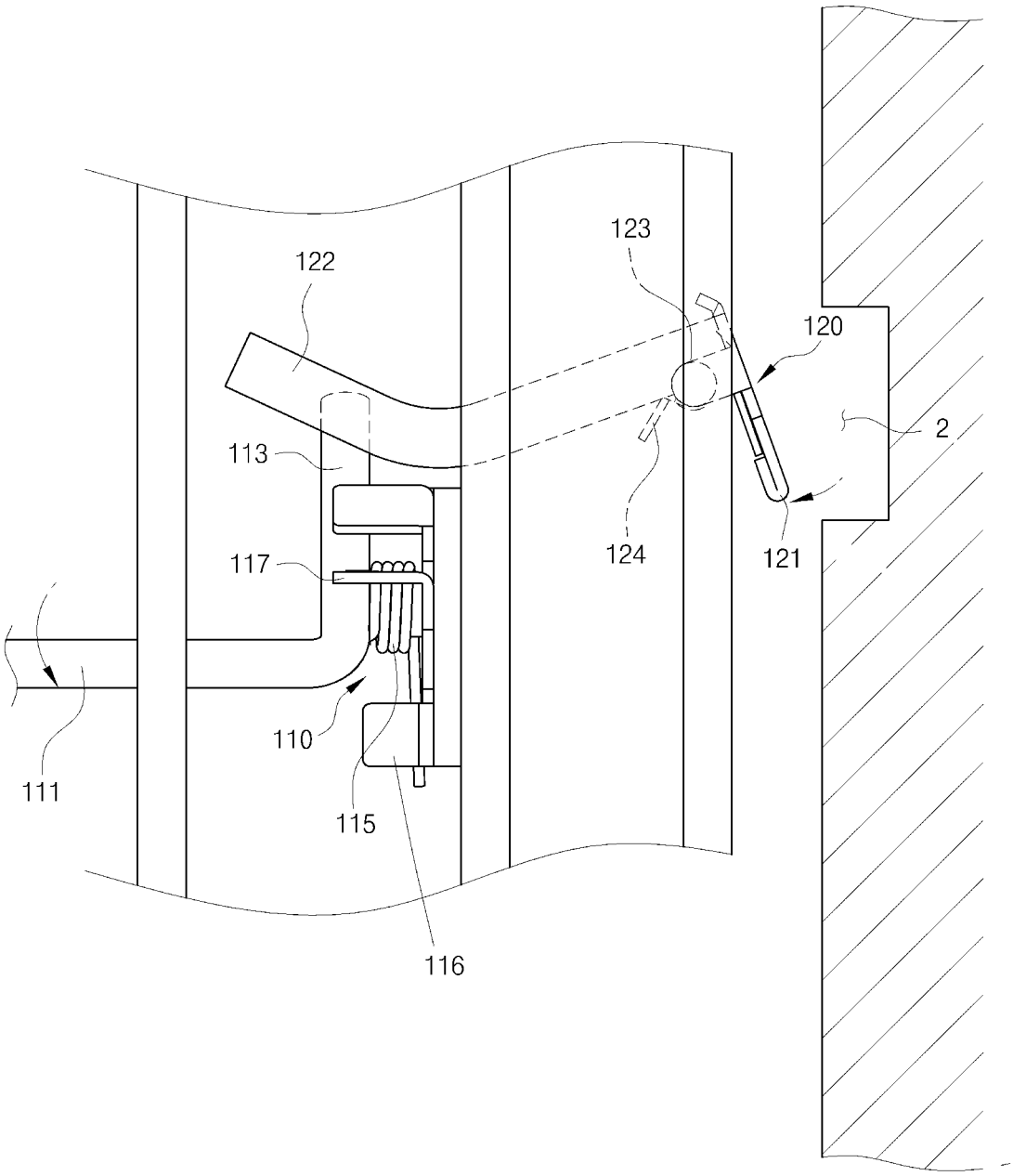
FIG. 8 illustrates the state where a sliding grill is unfixed by the sliding grill fixing apparatus of FIG. 5.

FIG. 7 illustrates the state where a sliding grill is fixed by the sliding grill fixing apparatus of FIG. 5, and FIG. 8 illustrates the state where a sliding grill is unfixed by the sliding grill fixing apparatus of FIG. 5.

Referring to FIGS. 7 and 8, the sliding grill 10 is taken into the cooking utensil 1, and the actuating brackets 121 are inserted into the fixing recesses 2, so that the sliding grill 10 is fixed. In order to take the fixed sliding grill 10 out of the cooking utensil, the user inserts his/her hand into the sliding grill 10 having a net shape, and grips the grip 112 of the actuating lever 111. The user who grips the grip 112 pulls the actuating lever 111 in a forward direction of the sliding grill 10. When the actuating lever 111 is pulled in the forward direction, the lower portions of the actuating legs 113 coupled with the actuating hinges 114 disposed on the opposite inner faces of the sliders 11 rotate to move backward, and the rotation of the actuating legs 113 subjects the actuating elastic members 115 to torsion. When the actuating legs 113 move backward, the driving brackets 122 located in the rear of the actuating legs 113 come into contact with the actuating legs 113, and move backward. When the driving brackets 122 move backward, the actuating brackets 121 integrally formed with the driving brackets 122 rotate about the fixing hinges 123, and move toward the outer faces of the sliders 11. The fixing elastic members 124 are subjected to torsion by the rotation of the actuating brackets 121. When the actuating brackets 121 rotate, the actuating brackets 121 are removed from the fixing recesses 2, and thus the sliding grill 10 is unfixed. Consequently, the user manipulates the actuating lever 111 of the sliding grill fixing apparatus 100 with one hand, so that the sliding grill 10 is unfixed.

When the sliding grill 10 is unfixed, the user releases an actuating force of the actuating lever. When the actuating force of the actuating lever is released, the actuating legs 113 return to their initial positions by means of the elastic force of the actuating elastic members 115 that have been subjected to torsion. Here, when rotating to return, the actuating legs 113 are stopped at their initial positions by the stoppers 117 located in the rear thereof, so that the actuating legs 113 can be operated again at their initial positions.

When the sliding grill 10 is put in another time, the actuating brackets 121 elastically supported by the fixing elastic members 124 are rotated against the elastic force of the fixing elastic members 124, move along an inner wall of the cooking utensil 1, and are inserted into the fixing recesses 2, so that the sliding grill 10 is fixed by the elastic force without separately operating the actuating lever 111. Thus, the sliding grill 10 is automatically fixed while being put in, and thus it is possible to easily fix the sliding grill 10.

When the actuating legs 113 are returned by the elastic force of the actuating elastic members 115, the actuating legs 113 lose the propulsive force that is required to move the driving brackets 122 in a backward direction. When the propulsive force is lost, the actuating brackets 121 integrally formed with the driving brackets 122 rotate about the fixing hinges 123 by means of the elastic force of the fixing elastic members 124 that have been subjected to torsion, and thus are inserted into the fixing recesses 2 of the cooking utensil. When the actuating brackets 121 are inserted into the fixing recesses 2, the sliding grill 10 can be fixed to the cooking utensil 1 by the sliding grill fixing apparatus 100. Here, the driving brackets 122 rotate to come into contact with the actuating legs 113 because they are integrally formed with the actuating brackets 121. The driving brackets 122 stop rotating when they come into contact with the actuating legs 113. In other words, the driving brackets 122 can stay in the stopped state because the actuating legs 113 serve as stoppers.

As described above, when the user operates the actuating lever 111 with one hand, the actuating brackets 121 disposed on the opposite sides of the actuating lever are rotated, and thus the sliding grill 10 is unfixed. The operating force is removed from the actuating lever 111, the actuating brackets 121 are rotated to the fixed position. In other words, the actuating brackets 121 fixed to the opposite sides of the sliding grill 10 can be simultaneously operated by the operation of the actuating lever 111, so that the convenience of the operation is improved.

According to an exemplary embodiment of the present invention, the actuating lever connects the locking units, which are disposed on the opposite sides of the sliding grill that is slidably installed in the cooking utensil which cooks stuff to be cooked, with each other so as to be operated at the same time, so that the locking units installed on the opposite sides of the sliding grill are released by being manipulated a single time, and thus the sliding grill is unfixed. Thereby, the user can operate the actuating lever with one hand, and thus the convenience of use is improved.

Further, the actuating lever interconnecting the locking units installed on the opposite sides of the sliding grill simultaneously distributes its operating force to both locking units with one operation, so that the actuating lever is prevented from being damaged by concentration the operating force in one direction, and thus increases duration.

Also, the locking units installed on the opposite sides of the sliding grill are simultaneously operated by one manipulation, and the outside locking units can be released to unfix the sliding grill. The locking units installed on the opposite sides of the sliding grill can be reliably operated, so that it is possible to enhance accuracy of the operation.

In addition, the locking units have the respective elastic members such that the actuating lever gripped and operated with one hand is returned to its initial position, so that the sliding grill can be repetitively fixed and unfixed, and it is possible to improve the efficiency of operation.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sliding grill fixing apparatus, which is installed on a sliding grill, on opposite sides of which sliders are installed, so as to be fixed in fixing recesses inside a cooking utensil, comprising:

an actuating lever positioned under and across the entire sliding grill in a horizontal direction between opposite inner faces of the sliders and has a grip in the middle thereof;

actuating legs that protrude downward from opposite ends of the actuating lever;

actuating hinges that are disposed between the actuating legs and the opposite inner faces of the sliders in a horizontal direction and hinge the actuating legs to the opposite inner faces of the sliders so as to be able to be moved by rotation;

driving brackets, each of which is disposed in a direction from one side of each actuating leg toward an outer face of each slider and is moved to one side by rotation of each actuating leg;

actuating brackets that are disposed upward at outer ends of the driving brackets so as to be parallel to the outer faces of the sliders and move together with the driving brackets to be inserted into the fixing recesses; and fixing hinges, each of which is disposed between each actuating bracket and the outer face of each slider and is hinged to the outer face of each slider such that each actuating bracket can rotate, wherein when the actuating lever is operated to another side with the grip gripped by a user, the actuating legs rotate about the actuating hinges and move the driving brackets in one direction; and when the driving brackets are moved in one direction by the rotation of the actuating legs, the actuating brackets rotate about the fixing hinges so as to release a fixed state where the actuating brackets are inserted into the fixing recesses.

2. The sliding grill fixing apparatus as set forth in claim 1, further comprising actuating elastic members, each of which encloses an outer surface of each actuating hinge and elastically supports each actuating leg, wherein the actuating elastic members are subjected to torsion when the actuating lever is operated, and allow the actuating lever to return to initial positions thereof after the actuating lever is operated.

3. The sliding grill fixing apparatus as set forth in claim 2, further comprising:

elastic member supports, each of which protrudes inward with respect to the inner face of each slider, is located on one side of a lower portion of each actuating leg, and supports a lower end of each actuating elastic member, an upper end of which is supported on one side of an upper portion of each actuating leg; and stoppers, each of which protrudes inward with respect to the inner face of each slider, is located on the other side of the upper portions of each actuating leg, and restricts a rotating range of each actuating leg, wherein each actuating leg rotating about each actuating hinge receives an elastic force applied from one side to the other side of the upper portion thereof by each actuating elastic member supported by each elastic member support, and each stopper restricts the rotation of each actuating leg, which is rotated by the elastic force of each actuating elastic member, to allow each actuating leg to maintain the initial position thereof.

4. The sliding grill fixing apparatus as set forth in claim 1, further comprising fixing elastic members, each of which encloses an outer surface of each fixing hinge and elastically supports each actuating bracket, wherein the fixing elastic members are subjected to torsion when the actuating lever is operated, and allow the actuating brackets to be returned to positions where the actuating brackets are inserted into the fixing recesses before the actuating lever is operated, and the actuating brackets elastically supported by the fixing elastic members are inserted into and fixed in the fixing recesses by the elastic force of the fixing elastic members, which are subjected to torsion when the sliding grill is inserted, without operating the actuating lever.

* * * * *